US006481970B2

(12) United States Patent
Mukherjee et al.

(10) Patent No.: US 6,481,970 B2
(45) Date of Patent: Nov. 19, 2002

(54) COMPRESSOR WHEEL WITH PRESTRESSED HUB AND INTERFERENCE FIT INSERT

(75) Inventors: Shankar Mukherjee, Torrance, CA (US); Peter Yao Tang, Buena Park, CA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/874,816

(22) Filed: Jun. 5, 2001

(65) Prior Publication Data

US 2002/0001522 A1 Jan. 3, 2002

Related U.S. Application Data

(60) Provisional application No. 60/214,619, filed on Jun. 28, 2000.

(51) Int. Cl.[7] ..... F04D 29/20
(52) U.S. Cl. ..... 416/204 A; 416/234; 416/244 A
(58) Field of Search ..... 416/234, 244 R, 416/244 A, 213 R, 204 A

(56) References Cited

U.S. PATENT DOCUMENTS

| | | | | |
|---|---|---|---|---|
| 2,443,688 A | * | 6/1948 | McFarland | 403/29 |
| 2,799,445 A | * | 7/1957 | Hull | 416/188 |
| 3,019,039 A | | 1/1962 | Clavell | |
| 3,715,176 A | | 2/1973 | Kerklo | |
| 4,060,337 A | | 11/1977 | Bell, III | |
| 4,915,589 A | * | 4/1990 | Gessler et al. | 416/241 B |
| 5,163,816 A | * | 11/1992 | Goetzke et al. | 416/204 A |

FOREIGN PATENT DOCUMENTS

| | | |
|---|---|---|
| CH | 233642 A | 8/1944 |
| DE | 4445297 C | 3/1996 |
| DE | 19515464 C | 10/1996 |
| DE | 19736333 C | 3/1999 |
| JP | 11843856 A | 6/1998 |

* cited by examiner

*Primary Examiner*—Edward K. Look
*Assistant Examiner*—Ninh Nguyen
(74) *Attorney, Agent, or Firm*—Ephraim Starr; Felix Fischer

(57) ABSTRACT

A compressor wheel (10) for a turbocharger having a prestressed hub (16) with an interference fit insert sized to provide the predetermined stress at zero rotational speed. The predetermined prestress then results in a reduced operating stress level during high speed rotation of the wheel, reducing the potential for reaching failure level stresses in operation and increasing wheel life.

7 Claims, 3 Drawing Sheets

COMPRESSOR WHEEL WITH PRESTRESSED HUB AND INTERFERENCE FIT INSERT

CROSS REFERENCE TO RELATED APPLICATIONS

This application claims the priority of application Ser. No. 60/214,619 filed on Jun. 28, 2000 having the same title as the present application.

BACKGROUND OF THE INVENTION

1. Field of the Invention

The present invention relates generally to compressor wheels for turbochargers. More particularly, a compressor wheel is provided with an interference fitted insert in the hub sized to create a predetermined pre-stress in the hub to reduce radial rotational stress during operation of the compressor in the turbocharger. The pre-stress will also reduce the difference between the peak and minimum circumferential stress values during transient operation.

2. Description of the Prior Art

Threaded-bore and through-bore compressor wheels typically have high bore stresses at the high rotational speeds present in operation of a turbocharger. Reduction of the radial component of the bore stresses and the difference between the peak and minimum circumferential stresses during transient operation will increase the life and operating speed for compressor wheels. Additionally, through bore compressor wheels have typically employed a securing nut which does not provide optimum aerodynamic performance of the wheel. A streamlined nose design is desirable to reduce the flow disturbance at the inlet hub and hence increase the performance efficiency.

SUMMARY OF THE INVENTION

The present invention provides a compressor wheel configuration and assembly process which results in high compressive stresses of a predetermined value near the bore after wheel assembly. During rotation of the wheel in operation, the stresses transition from compression to tension, and only then to the required tensile stress inducing failure, instead of going from zero stress to high tensile stresses as in the normal throughbore wheels. The stress variation of the circumferential stress during transient operation is also reduced. This increases the wheel operating speed and life.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
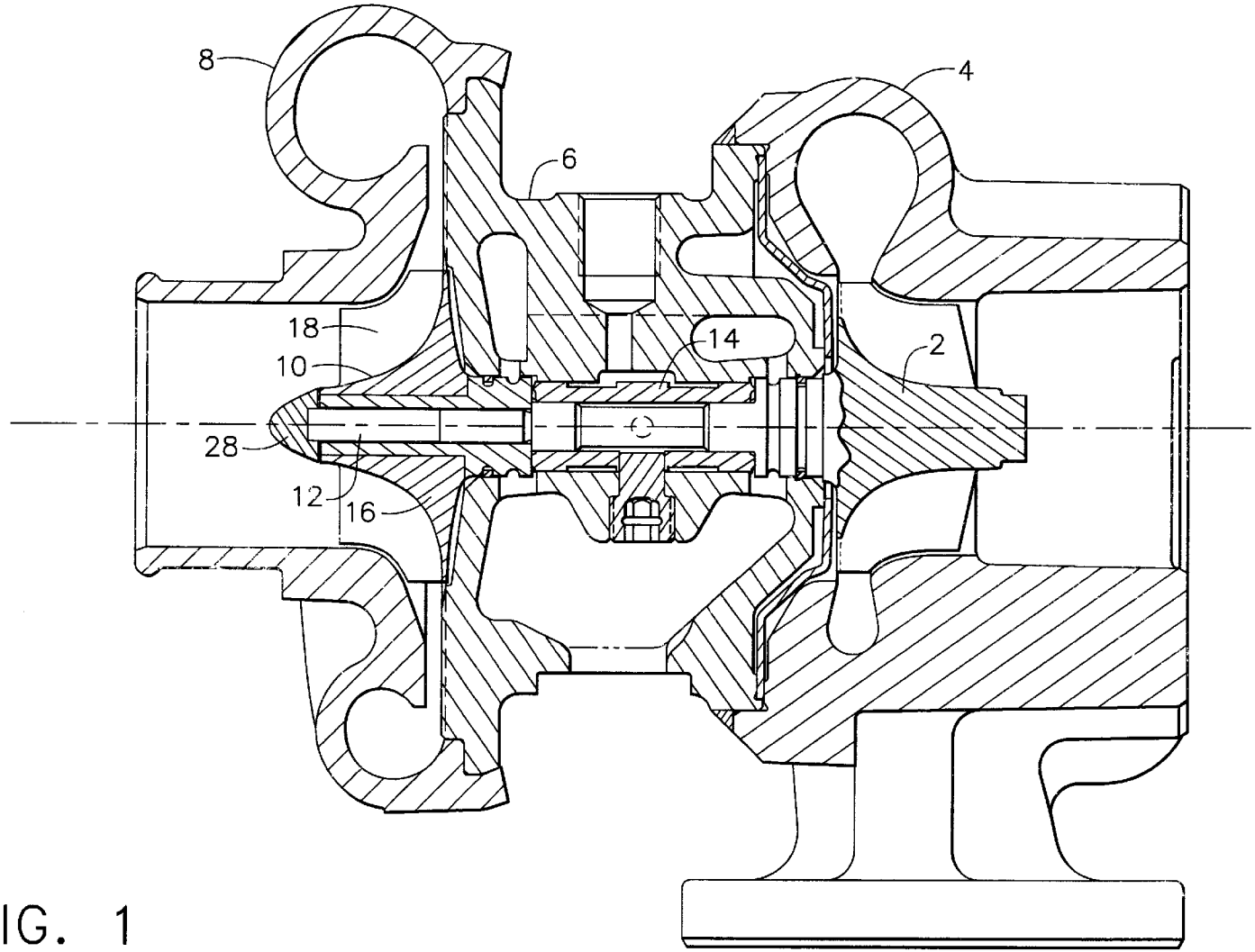
FIG. 1 is a side section elevation view of a turbocharger incorporating a compressor wheel employing the present invention.
Figure 2:
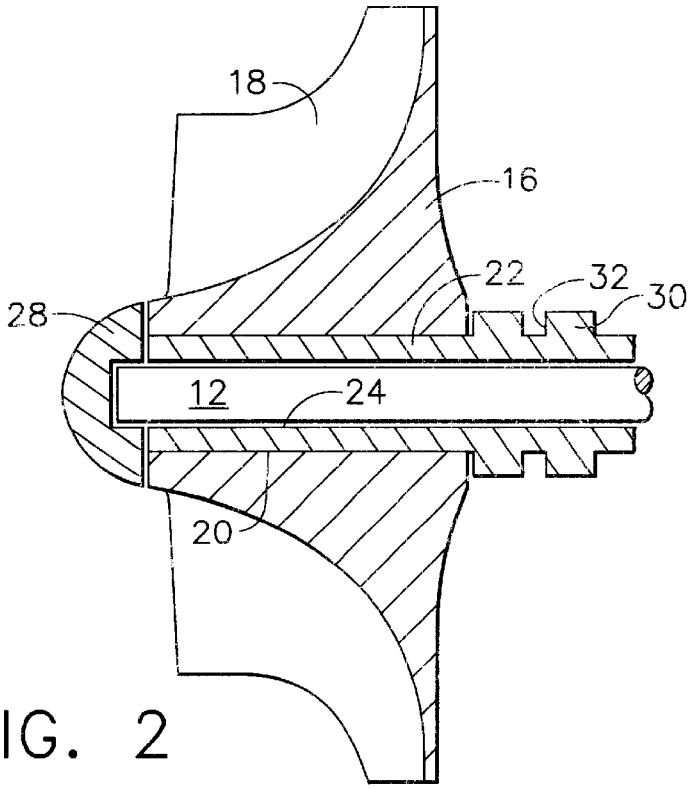
FIG. 2 is a section view of a compressor wheel showing a first embodiment of the present invention as also disclosed in FIG. 1.

Referring to the drawings, FIG. 1 shows a turbocharger incorporating the present invention. The turbocharger includes a turbine 2 enclosed in a turbine housing 4. The turbine housing is connected to a center housing 6 which is, in turn, connected to a compressor housing 8. A compressor wheel 10 is enclosed within the compressor housing and interconnected to the turbine by a shaft 12 carried by bearings 14 in the center housing. FIG. 2 shows an embodiment of the invention wherein compressor wheel 10 incorporates an outer hub 16 with attached blades 18. A first bore 20 extends through the hub concentric with an axis of rotation of the wheel. An inner compression sleeve 22 is fitted within the bore. The compression sleeve incorporates a smaller diameter bore 24 to receive the shaft interconnecting the compressor and turbine. In the embodiment shown in FIG. 2, a separate nose insert 28 incorporates the nut and is threaded on to the shaft. The bore in the nose insert into which the shaft threads is alternatively a partial hole as shown in the figure or a through hole. A spacer 30 is provided with a piston ring groove 32 integral with the compression sleeve. This streamlined nose design reduces flow distortions at the nose and thus improves aerodynamic performance of the wheel.

Figure 3:
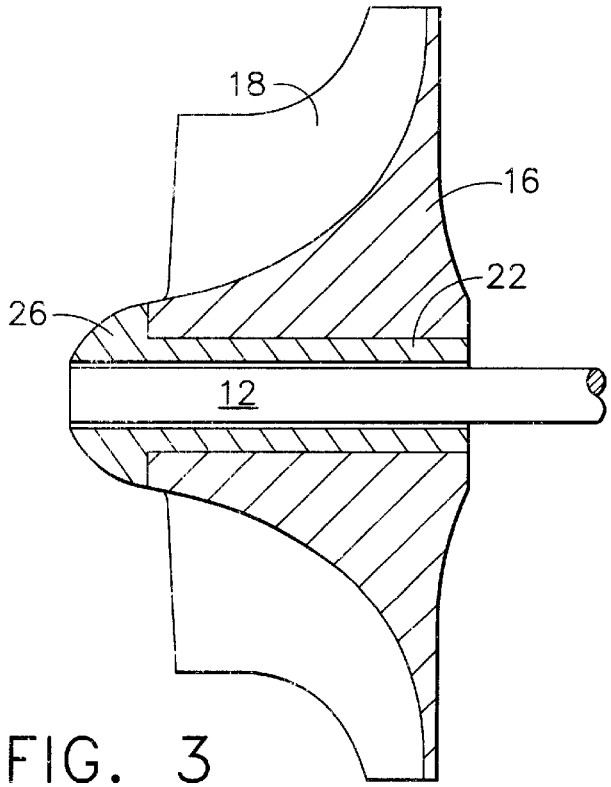
FIG. 3 is a section view of a compressor wheel showing a second embodiment of the present invention.
Figure 4:
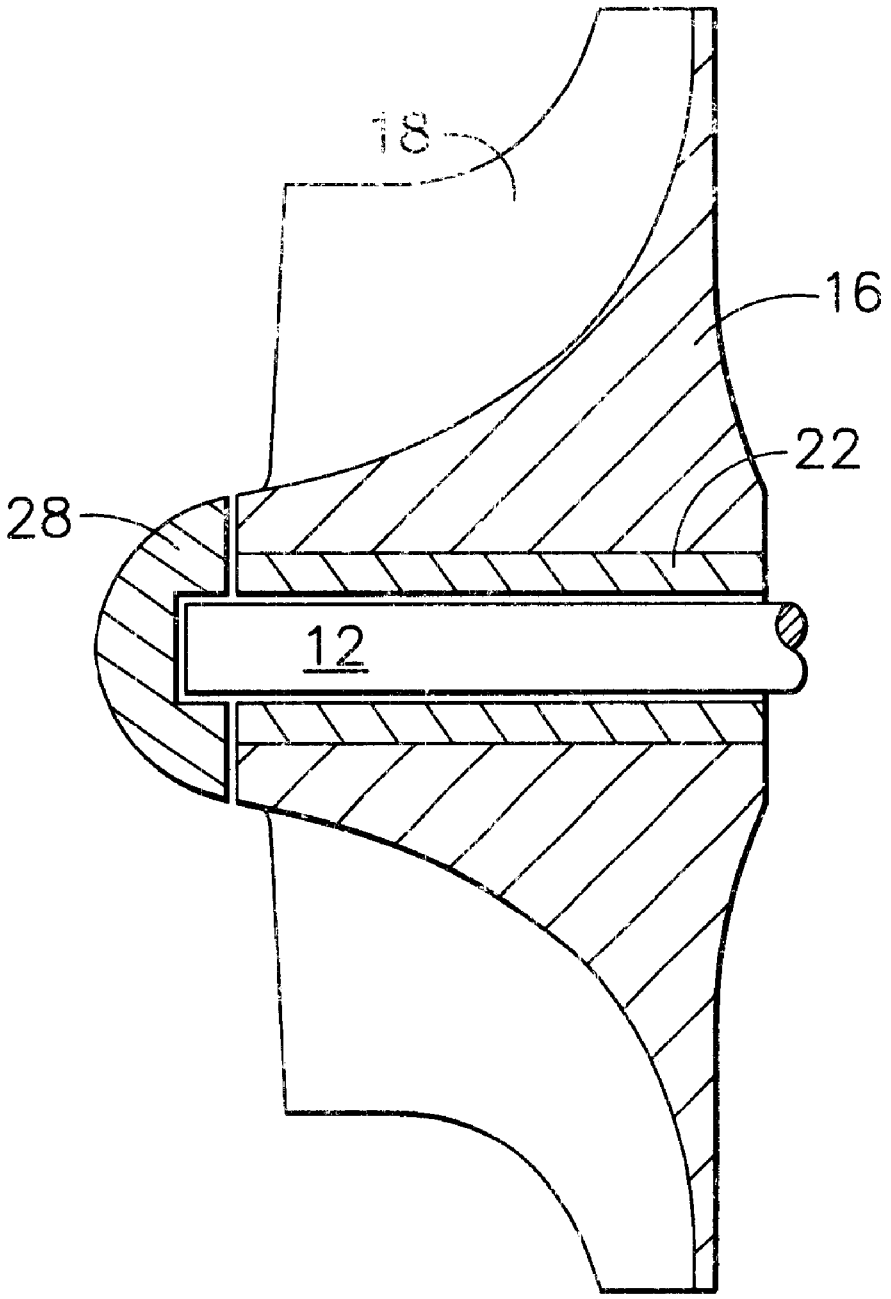
FIG. 4 is a section view of a compressor wheel showing a third embodiment of the present invention.

FIG. 3 illustrates a second embodiment of the invention, wherein an integral nut 26 with a rounded shape is included as an integral portion of the insert. In a third embodiment shown in FIG. 4, the nut at the nose and the spacer (not shown) are separate components from the compression sleeve. The shaft is threaded for a predetermined length based on the embodiment.

Assembly of a compressor wheel incorporating the present invention is accomplished by initially threading the shaft into the sleeve. Then the sleeve is assembled into the hub using an interference fit. This fit induces a compressive stress in the hub and the sleeve. In operation, this stress opposes the tensile centrifugal radial stresses imposed on the rotating wheel. The resultant radial stress in operation must then transition from compression into tension and then to the fracture value of the stress to cause failure. The compressive pre-stress also reduces the difference between the peak and minimum circumferential stresses i.e. it reduces the circumferential stress variation (range) during transient operation. This increases the operating range of the wheel since the resultant radial stress and the circumferential stress variation in the bore region is much smaller than in prior art designs (without the sleeve) for the same rotational speed. This also increases the life of the wheel.

The generation of a compressive stress in the bore due to the interference fit is based on a desired predetermined value. The compressive stress magnitude is controlled by the amount of interference. In analyzing the desired interference, a particular interference is applied at zero rotational speed so that a compressive stress is created at the interference. Then the stresses in the wheel at the desired spin speed are analyzed using a finite element method. Due to the centrifugal effect, the compressive interference stress reduces. The correct interference at zero speed is then the interference which will produce the desired compressive interference stress at the desired spin speed. The correct compressive interference stress is the stress which will reduce the stress range i.e. minimize the difference between the maximum and minimum stresses in the bore and hence will contribute to increase in life of the wheel. The interference at zero speed is also a function of the coefficient of expansion of the material and the method of assembly.

The interference fit required in assembling the sleeve into the hub can be accomplished by one of several alternative methods; (a) by cooling the sleeve in liquid nitrogen or liquid helium and sliding the shrunken sleeve into the hub and allowing it to expand when it reaches room temperature, (b) heating the hub to expand the bore and sliding in the cold sleeve and allowing the hub to shrink onto the sleeve, (c) a combination of cooling the sleeve and heating the hub, and (d) making the inner surface of the hub bore and the outer surface of the sleeve tapered, lubricating the assembly surfaces and assembling the sleeve by applying a load onto the sleeve and pushing the sleeve into the hub bore under load. In the embodiments demonstrated in the drawings, the sleeve is made from the same material (such as an aluminum alloy) as the wheel or higher strength materials such as steels, other aluminum alloys, inconel and other high nickel alloys, GMR, titanium alloys, intermetalics, titanium aluminides, magnesium, copper and brass and their alloys, metal matrix composites, polymers and polymer matrix composites. In alternative embodiments, the sleeve is made from multiple segments also assembled with interference fits. The sleeve then is assembled into the hub with an interference fit.

Having now described the invention in detail as required by the patent statutes, those skilled in the art will recognize modifications and substitutions to the specific embodiments disclosed herein. Such modifications and substitutions are within the scope and intent of the present invention as defined in the following claims.

What is claimed is:

1. A compressor wheel comprising:

a hub having a first bore concentric with an axis of rotation of the wheel;

blades extending from the hub;

an insert received within the first bore in a predetermined interference fit, said interference reducing the circumferential stress variation, and said insert having means for attachment to a shaft for rotation of the wheel.

2. A compressor wheel as defined in claim 1 wherein the means for attachment of the shaft comprises a second bore in the insert sized to receive the shaft and means for securing the shaft.

3. A compressor wheel as defined in claim 2 wherein the means for securing comprises a nut having a diameter greater than said first bore and engaging said hub, the nut having an internal thread to receive a threaded end of the shaft.

4. A compressor wheel comprising:

a hub having a first bore concentric with an axis of rotation of the wheel;

blades extending from the hub;

an insert received within the first bore in a predetermined interference fit, said interference reducing the circumferential stress variation, and said insert having a second bore sized to receive a shaft; and a nut having a diameter greater than said first bore and engaging said hub, the nut having an internal thread to receive a threaded end of the shaft for securing the shaft and wherein the nut incorporates an aerodynamic outer surface forming a blended aerodynamic shape with the hub.

5. A compressor wheel as defined in claim 4 wherein the nut is integrally formed at one end of the sleeve.

6. A method for assembling a compressor wheel comprising the steps of:

assuming a particular interference by a sleeve inserted into a bore in a hub of the compressor wheel applied at zero rotational speed of the compressor wheel so that a compressive stress is created at the interference;

analyzing the resulting stresses in the wheel at the desired spin speed;

determining the compressive interference stress reduction due to centrifugal stresses; iterating the analysis to create the correct predetermined interference at zero speed to produce the desired compressive interference stress at the desired spin speed to reduce the stress range for increased life of the wheel;

assembling a sleeve with the predetermined interference into the bore of the compressor wheel.

7. A method for assembling a compressor wheel as defined in claim 6 further comprising the step of threading the sleeve onto a shaft.

* * * * *